US009209567B2

(12) United States Patent
Schaefer et al.

(10) Patent No.: US 9,209,567 B2
(45) Date of Patent: Dec. 8, 2015

(54) CLAMPING BODY FOR AN ELECTRICAL CONDUCTOR

(71) Applicant: PHOENIX CONTACT GMBH & CO. KG, Blomberg (DE)

(72) Inventors: Michael Schaefer, Bad Pyrmont (DE); Uwe Ambrosy, Bodenwerder (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/346,326

(22) PCT Filed: Sep. 20, 2012

(86) PCT No.: PCT/EP2012/003921
§ 371 (c)(1),
(2) Date: Mar. 21, 2014

(87) PCT Pub. No.: WO2013/041221
PCT Pub. Date: Mar. 28, 2013

(65) Prior Publication Data

US 2015/0180173 A1 Jun. 25, 2015

(30) Foreign Application Priority Data

Sep. 21, 2011 (DE) ..... 10 2011 053 823

(51) Int. Cl.
*H01R 13/03* (2006.01)
*H01R 43/16* (2006.01)
*H01R 13/639* (2006.01)
(Continued)

(52) U.S. Cl.
CPC ..... *H01R 13/639* (2013.01); *C22C 9/04* (2013.01); *H01R 4/36* (2013.01)

(58) Field of Classification Search
CPC ..... H01R 13/03; H01R 43/16
See application file for complete search history.

(56) References Cited

U.S. PATENT DOCUMENTS

| | | | | |
|---|---|---|---|---|
| 4,954,187 | A * | 9/1990 | Gaag et al. | 148/413 |
| 7,067,951 | B2 * | 6/2006 | Otani et al. | 310/248 |
| 2008/0240973 | A1 * | 10/2008 | Gaag et al. | 420/480 |

(Continued)

FOREIGN PATENT DOCUMENTS

| | | | |
|---|---|---|---|
| DE | 2217851 | A1 | 10/1973 |
| DE | 3640824 | A1 | 6/1988 |

(Continued)

OTHER PUBLICATIONS

Ecomercia—Diehl Metall Stiftung & Co. KG: Bleiarme Messing-Legierungen für den Trinkwasserbereich nach US-Gesetzgebung, Oct. 2011, http://www.diehl.com/diehlmetall.

(Continued)

*Primary Examiner* — Gary Paumen
(74) *Attorney, Agent, or Firm* — Leydig, Voit & Mayer, Ltd.

(57) ABSTRACT

A clamping body for an electrical conductor includes a clamping body pocket. The clamping body pocket forms a receiving space for receiving the electrical conductor. The clamping body pocket is formed from a copper zinc alloy that has a lead content of less than 0.1 percent by weight, a tensile strength that is at least 640 Newtons per square millimeter, and an elongation A10 at rupture that is at least 5 percent. The clamping body also includes a threaded bore for receiving a screw, the threaded bore being formed in a side wall of the clamping body pocket.

12 Claims, 1 Drawing Sheet

(51) Int. Cl.
*C22C 9/04* (2006.01)
*H01R 4/36* (2006.01)

(56) References Cited

U.S. PATENT DOCUMENTS

| | | | | |
|---|---|---|---|---|
| 2009/0070998 | A1 | 3/2009 | Follmann | |
| 2012/0207642 | A1 | 8/2012 | Zeiger et al. | |
| 2012/0267011 | A1* | 10/2012 | Lawrence | 148/283 |
| 2013/0115128 | A1* | 5/2013 | Lawrence | 420/476 |
| 2013/0330227 | A1* | 12/2013 | Gaag et al. | 420/479 |

FOREIGN PATENT DOCUMENTS

| | | | |
|---|---|---|---|
| DE | 8704710 | U1 | 7/1988 |
| DE | 19813753 | A1 | 9/1999 |
| DE | 10215985 | A1 | 11/2003 |
| DE | 102005061732 | A1 | 7/2007 |
| DE | 102009038657 | A1 | 2/2011 |
| JP | 58128516 | A | 8/1983 |
| JP | 62130294 | A | 6/1987 |

OTHER PUBLICATIONS

Hornbogen, et al., Aufbau und Eigenschaften von Keramik-, Metall-, Polymer- und Verbundwerkstoffen, Dec. 2008, pp. 347-360, http://www.springer.com/978-3-540-71857-4.

International Search Report, PCT/EP2012/003921, May 30, 2013.

German Office Action, dated Aug. 31, 2012.

* cited by examiner

CLAMPING BODY FOR AN ELECTRICAL CONDUCTOR

CROSS-REFERENCE TO RELATED APPLICATIONS

This application is a U.S. National Phase application under 35 U.S.C. §371 of International Application No. PCT/EP2012/003921, filed on Sep. 20, 2012, and claims benefit to German Patent Application No. DE 10 2011 053 823.2, filed on Sep. 21, 2011. The International Application was published in German on Mar. 28, 2013 as WO 2013/041221 A2 under PCT Article 21 (2).

FIELD

The invention relates to a clamping body for an electrical conductor with a clamping body pocket which forms a receiving space for receiving the electrical conductor, a threaded bore for receiving a screw being formed in a side wall of the clamping body pocket. Furthermore, the invention relates to an electrical connecting terminal with such a clamping body.

BACKGROUND

Clamping bodies in the form of a screw connection are used, for example, in electrical connecting terminals such as terminal blocks or lustre terminals. Electrical connecting terminals with screw connections are characterised by their high clamping forces, which are transferable to electrical conductors consistently for years. With this type of terminal, predetermined high clamping forces can be maintained without fluctuations, even with vibrations acting on the electrical connecting terminal. Due to these characteristics, electrical connecting terminals with screw connections are also used as a preference in high-performance industrial applications with moving and vibrating machine components.

To construct an electrical connecting terminal, the clamping body is normally arranged inside a housing made of insulating material. The clamping body pocket of the clamping body can be constructed from an electrically conductive material. A threaded bore, into which a screw is inserted and which is guided as far as the inside of the receiving space of the clamping body, is formed on a side wall of the clamping body pocket. The screw head of the screw is accessible via an opening provided in the housing made of insulating material such that the screw can be turned with its tip into the receiving space and can clamp an electrical conductor that has been inserted here. It is, however, also possible that when the screw is turned, the screw pulls the clamping body upwards and pushes the conductor against a current bar such that no direct contact occurs between conductor and screw.

The clamping body pocket can be produced from a curved strip-shaped sheet metal element, which is curved or folded according to the contour of the clamping body pocket. Furthermore, the clamping body pocket can be produced from a solid profile, which is processed accordingly by machining processes, such as sawing, drilling, milling, broaching or thread cutting, for example, in order to obtain the form of the clamping body pocket. In contrast to a clamping body pocket produced from a curved strip-shaped sheet metal element, the clamping body pocket produced from a solid profile has a more consistent outer contour, since no folding or bending points have to be provided. Moreover, a clamping body pocket produced from a solid profile can be constructed with smaller dimensions than a clamping body pocket produced from a curved strip-shaped sheet metal element, so that the space requirement for the clamping body pocket can be reduced. Moreover, clamping body pockets produced from a solid profile can have a longer threaded bore, as a result of which, by means of the screw inserted into the threaded bore, a higher torque and therefore a higher axial force can be applied to the electrical conductor clamped by the screw. In order to improve the processing, in particular in relation to the machine processing, of the material for producing a clamping body, it is usual to apply lead to the material of the clamping body. This added lead is, however, a disadvantage when compliance with the EU lead-free directive (regulations regarding the restriction of certain hazardous substances in the electrical and electronic industry and end-of-life vehicle regulations) is required.

SUMMARY

In an embodiment, the present invention provides a clamping body for an electrical conductor. The clamping body includes a clamping body pocket. The clamping body pocket forms a receiving space for receiving the electrical conductor. The clamping body pocket is formed from a copper zinc alloy that has a lead content of less than 0.1 percent by weight, a tensile strength that is at least 640 Newtons per square millimeter, and an elongation A10 at rupture that is at least 5 percent. The clamping body also includes a threaded bore for receiving a screw, the threaded bore being formed in a side wall of the clamping body pocket.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
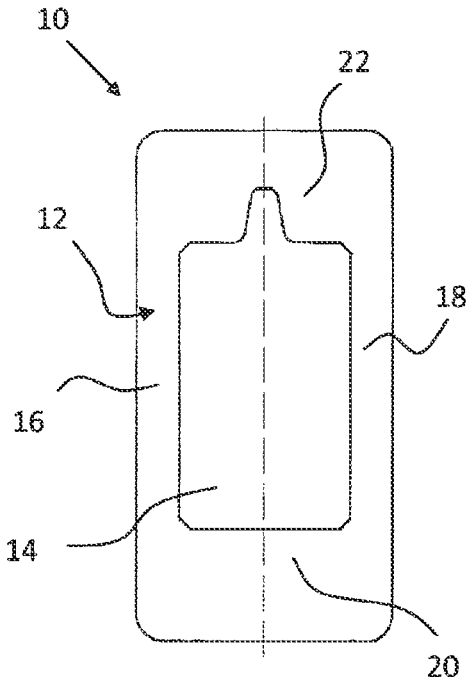
FIG. 1 shows a schematic side view of a clamping body according to an embodiment of the invention.

An aspect of the invention provides a clamping body and an electrical connecting terminal which comply with the EU directives and the regulations regarding the restriction of hazardous substances and at the same time exhibit good machinability in their production.

In an embodiment, the present invention provides a clamping body pocket that is formed from a copper-zinc alloy that has a lead content Pb<0.1 wt %, a tensile strength Rm≥640 N/mm2 and an elongation at rupture A10≥5%.

Surprisingly, it has become apparent that when a copper-zinc alloy which has a lead content Pb<0.1 wt %, a tensile strength Rm≥640 N/mm2 and an elongation at rupture A10≥5% is used for a clamping body pocket, substantially the same properties can be achieved as when using a material provided with added lead. In particular, just as good a machinability of the material can be achieved without the added lead being necessary. As a result of an alloy now being used which has no added lead, the clamping body according to the invention and the clamping body pocket of the clamping body comply with the EU lead-free directive and the regulations on the restriction of certain hazardous substances. Moreover, the manufacturing costs of the clamping body can be reduced as a result of the added lead no longer being necessary. Because the copper-zinc alloy has a tensile strength Rm≥640 N/mm2, the copper-zinc alloy and therefore the clamping body pocket has no or at least a very low relaxation so that the functionality, in particular the clamping capacity and the clamping force, of such a clamping body has a very high service life when clamping an electrical conductor without the clamping effect weakening since the material of the clamping body pocket can be prevented from yielding and expanding due to the tension being applied through the clamping force because of the good mechanical properties, in particular the high tensile strength of the material of the clamping body pocket Rm≥640 N/mm2 Furthermore, as a result of the elongation at rupture of A10≥5% it is ensured that the copper-zinc alloy is easy to process, in particular it has good deformability and good machinability.

According to an embodiment of the invention, the copper-zinc alloy has a zinc content of Zn≥40 wt %. As a result of the high zinc content in the alloy, the ease of processing with respect to deformability and machinability of this alloy can be improved without lead having to be added, so that the manufacturing costs of the clamping body pocket can also be further reduced.

In certain embodiments, the copper-zinc alloy to be CuZn42. This specific alloy CuZn42, which has a needle-shaped microstructure, is characterised by its ease of processing because of easy machinability without lead content being necessary in the alloy. Furthermore, this specific copper-zinc alloy has a high corrosion resistance and, as a result of the high elongation at rupture, a secure clamping of a conductor with such a clamping body pocket can also be guaranteed with a very long service life.

According to another embodiment of the invention it is provided for the clamping body pocket to be provided with a surface coating. The surface coating can, for example, be formed by nickel electroplating, as a result of which high torques are possible, in particular when screwing a screw into the threaded bore formed in the clamping body pocket. Before applying the nickel coating, the surface of the copper-zinc alloy of the clamping body pocket is pickled. In certain embodiments, the thickness of the nickel coating is between 1 and 3 μm. It is also possible to provide a copper sub-layer as the surface coating. It is, however, also possible not to provide any surface coating at all.

According to another embodiment of the invention, the clamping body pocket is formed from a solid profile. Solid profile here means that the clamping body pocket is produced from one piece, such as a rectangular profiled wire, which is processed accordingly by means of milling, broaching and drilling, in order to form a clamping body pocket with a receiving space to receive an electrical conductor and a threaded bore. As a result of the good machinability of the copper-zinc alloy used, the production of a clamping body pocket according to the invention from a solid profile is particularly feasible.

Alternatively, it is provided according to another embodiment of the invention for the clamping body pocket to be formed out of a curved strip-shaped element. As a result of the high elongation at rupture of A10≥5% of the copper-zinc alloy used, the copper-zinc alloy used has a good deformability, as a result of which the production of a clamping body pocket formed from a curved strip-shaped element is easily feasible at reasonable cost.

Figure 2:
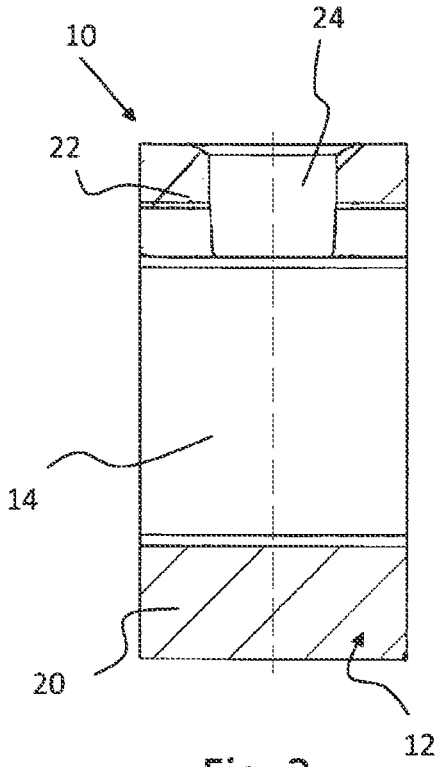
FIG. 2 shows a schematic cross-sectional view of the clamping body shown in FIG. 1.
Figure 3:
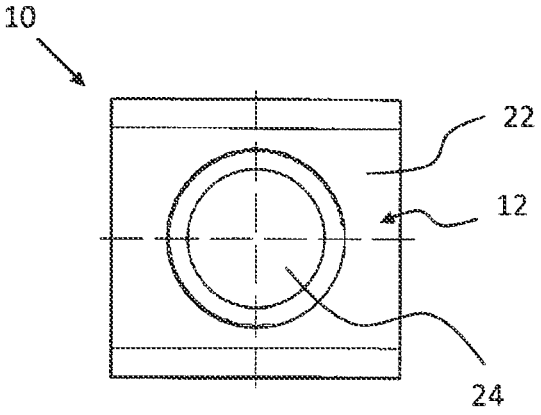
FIG. 3 shows a schematic plan view of the clamping body shown in FIG. 1.

The clamping body 10 shown in FIGS. 1 to 3 has a clamping body pocket 12 which is formed from a solid profile and is produced from a rectangular profiled wire, for example, by machining, in particular milling, broaching and drilling. The clamping body pocket 12 has a receiving space 14, which is formed as a through-hole introduced at the side, as can be seen in FIG. 2, through which an electrical conductor, which is to be clamped and connected can be introduced. The receiving space 14 is bordered by a first side wall 16, a second side wall 18, a side wall 20 on the base and a side wall 22 on the top of the clamping body pocket 12.

As can be seen in FIG. 2, a threaded bore 24 is formed in the top side wall 22 for receiving a screw by means of which the conductor, which has been inserted into the receiving space 14, can be clamped and connected.

In FIG. 3 the clamping body 10 is shown in a plan view of the top side wall 22 in which the threaded bore 24 is provided.

The clamping body pocket 12 is formed from a copper-zinc alloy, for example CuZn42, with a lead content Pb<0.1 wt %, a copper content Cu of 58 wt %, a zinc content Zn of 42 wt %, a tensile strength Rm 640 N/mm2 and an elongation rupture A10 5%, characterised by a particularly good machinability, very good corrosion resistance, no or very low relaxation properties and low manufacturing costs.

LIST OF REFERENCE NUMERALS

Clamping body 10
Clamping body pocket 12
Receiving space 14
Side wall 16
Side wall 18
Side wall 20
Side wall 22
Threaded bore 24

The invention claimed is:

1. A clamping body for an electrical conductor, the clamping body comprising:

a clamping body pocket forming a receiving space for receiving the electrical conductor; the clamping body pocket being formed from a copper zinc alloy that has a lead content of less than 0.1 percent by weight, a tensile strength that is at least 640 Newtons per square millimeter, and an elongation A10 at rupture that is at least 5 percent; and a threaded bore for receiving a screw, the threaded bore being formed in a side wall of the clamping body pocket.

2. The clamping body as recited in claim 1, wherein the copper zinc alloy has a zinc content of at least 40 percent by weight.

3. The clamping body as recited in claim 1, wherein the copper zinc alloy is CuZn42.

4. The clamping body as recited in claim 1, wherein the clamping body pocket has a surface coating.

5. The clamping body as recited in claim 1, wherein the clamping body pocket includes a solid profile.

6. The clamping body as recited in claim 1, wherein the clamping body pocket includes a curved, strip-shaped element.

7. An electrical connecting terminal comprising:

a clamping body for an electrical conductor, the clamping body comprising:

a clamping body pocket forming a receiving space for receiving the electrical conductor; the clamping body pocket being formed from a copper zinc alloy that has a lead content of less than 0.1 percent by weight, a tensile strength that is at least 640 Newtons per square millimeter, and an elongation A10 at rupture that is at least 5 percent; and a threaded bore for receiving a screw, the threaded bore being formed in a side wall of the clamping body pocket.

8. The electrical connecting terminal as recited in claim 7, wherein the copper zinc alloy has a zinc content of at least 40 percent by weight.

9. The electrical connecting terminal as recited in claim 7, wherein the copper zinc alloy is CuZn42.

10. The electrical connecting terminal as recited in claim 7, wherein the clamping body pocket has a surface coating.

11. The electrical connecting terminal as recited in claim 7, wherein the clamping body pocket includes a solid profile.

12. The electrical connecting terminal as recited in claim 7, wherein the clamping body pocket includes a curved, strip-shaped element.

* * * * *